US006471075B2

(12) United States Patent
Robichaux

(10) Patent No.: US 6,471,075 B2
(45) Date of Patent: Oct. 29, 2002

(54) ADJUSTABLE PIPE RACK

(76) Inventor: Richard J. Robichaux, 5033 U.S. Hwy. 90 E. Frontage Rd., Broussard, LA (US) 70518

( * ) Notice: Subject to any disclaimer, the term of this patent is extended or adjusted under 35 U.S.C. 154(b) by 0 days.

(21) Appl. No.: 09/779,321

(22) Filed: Feb. 8, 2001

(65) Prior Publication Data

US 2002/0104812 A1 Aug. 8, 2002

(51) Int. Cl.[7] ..... E21B 19/14
(52) U.S. Cl. ..... 211/70.4
(58) Field of Search ..... 211/70.4, 60.1, 211/70.1, 85.18, 162, 189, 195, 175

(56) References Cited

U.S. PATENT DOCUMENTS 1,393,054 A * 10/1921 Turner
1,867,611 A * 7/1932 Borrmann
3,400,828 A * 9/1968 May
3,945,497 A * 3/1976 Greenberg
4,616,757 A * 10/1986 Hobson
5,385,247 A * 1/1995 Owens
5,743,413 A * 4/1998 Noll
6,202,863 B1 * 3/2001 Grenier

* cited by examiner

*Primary Examiner*—Alvin Chin-Shue
*Assistant Examiner*—Sarah Purol
(74) *Attorney, Agent, or Firm*—Jesse D. Lambert

(57) ABSTRACT

A rack which can be used in connection with the storage and transportation of pipe and other tubular goods. The rack is adjustable to accommodate many different types of tubular goods, and keep such different tubular goods segregated from one another. A horizontal track is provided with at least two vertical divider posts which can slide along the length of the track. The vertical divider posts can be locked in place at desired intervals along the horizontal track, thereby defining a plurality of compartments for holding pipe or other tubular goods.

15 Claims, 6 Drawing Sheets

ADJUSTABLE PIPE RACK

BACKGROUND OF THE INVENTION

1. Field of the Invention

The present invention relates to a rack which can be used in connection with the storage and transportation of pipe and other tubular goods. More particularly, the present invention relates to a rack which is adjustable to accommodate many different sizes of tubular goods, and to keep such different tubular goods segregated from one another. More particularly still, the present invention relates to a rack which can be used primarily on boats or other marine applications.

2. Description of the Related Art

The storage and transportation of cylindrical items, such as tubing and pipes, has long presented challenges. These challenges, which exist in many different settings, are particularly acute with respect to the oil and gas industry. This is especially true with respect to offshore oil and gas operations. In such instances, large amounts of tubular goods must typically be transported from shore to a marine location such as an offshore drilling rig or production platform.

In the oil and gas industry, tubular goods, such as casing, drill pipe and production tubing, typically are segmented into separate sections called "joints." Each joint generally ranges in length from 30 to 40 feet, depending upon the type and diameter of the particular tubular good. Such joints must generally be transported from a land-based facility to a desired marine location via one or more work boats or barges. Obviously, the deeper the well, the greater the length of pipe needed and, thus, the more joints of pipe which must be transported.

As existing oil and gas reservoirs become mature and depleted, the drilling of oil and/or gas wells is occurring in more extreme environments. For example, in the Gulf of Mexico, drilling is taking place beyond the outer continental shelf in significantly deeper water. Furthermore, advances in drilling technology has made it possible to drill wells to a greater total depth. Both of these applications require large amounts of tubular goods, that is, many joints of pipe, which must be delivered to the ultimate destination via work boats or other marine transportation. Further, because the design parameters of such wells can often require several different types and/or sizes of tubular goods, there is also a need to transport many different sizes and/or types of such tubular goods to a particular marine location. In some instances, it may be desirable to utilize the same size pipe in a well, but said pipe may have different threaded connections or different strength characteristics.

For reasons which are readily apparent, it is generally beneficial to transport such tubular goods as efficiently as possible. Further, it is generally advantageous to keep the different sizes of tubular goods segregated to assist in the loading and unloading process once the shipment has reached its ultimate destination. Because bundles of such tubular goods are generally unloaded from a work boat or other marine vessel using a crane, it is generally advantageous to keep the different sizes and types of such tubular goods separated and/or segregated to allow for such unloading in an efficient manner. If such tubulars are segregated, each load can be tied together using slings; the entire load can then be lifted using such slings.

It is desirable to keep tubular goods contained or bolstered on the deck of a boat during transportation of such tubular goods. Rough seas can cause a boat to rock, which in turn could cause tubular goods on the deck of such boat to roll around. Thus, it is desirable to keep such tubular goods stationary and in a fixed position for safety reasons.

SUMMARY OF THE INVENTION

The present invention comprises a rack which can accommodate many different types and sizes of tubular goods. The present invention is adjustable, in that it can be configured as desired to provide a plurality of separate compartments which can receive different tubular goods. Although the rack of the present invention can be used in a number of different applications, one such application is in connection with the transportation of tubular goods to marine locations on boats or other vessels.

In the preferred embodiment, the present invention comprises a horizontal track and a plurality of vertical members. One of said vertical members, a vertical end member, is generally positioned at or near one end of said horizontal track. Said vertical end member generally forms one side of the rack of the present invention, and said horizontal track forms the base of said rack. In the preferred embodiment, said horizontal track has a plurality of holes therethrough. A plurality of upright support members are situated on said horizontal track. In the preferred embodiment, said upright support members are equipped with a base which is slidably received on said horizontal track, thereby permitting said upright support members to be placed at desired positions along said horizontal track. In the preferred embodiment, the bases of said upright support members also have holes which can be aligned with the holes in said horizontal track; once positioned at the desired locations, said upright support members can be pinned or otherwise secured in place. In this manner, the pipe rack of the present invention can be adjusted to accommodate numerous different sizes and types of tubular goods.

Although the rack of the present invention can be utilized or configured in any number of ways, one use is on the deck of a work boat or other marine vessel. Generally, when transporting a large number of tubular goods, the rack of the present invention is positioned so that the vertical end member is located near one side of said boat, and said horizontal track extends from side to side across the deck of the boat. Said upright support members are positioned at desired intervals along the extent of said horizontal track, thereby defining a number of different compartments or segments. When being used for the handling of long tubular goods, two or more of said racks can be used in parallel fashion to further accommodate the length of such tubular goods.

Each upright support member is comprised of a rigid frame. In the preferred embodiment, the frame of each upright member is constructed of metal or some other strong and durable material. Further, the surfaces of such upright support members which could potentially come in contact with tubular goods stored or loaded within said rack are lined with wood or some similar non-abrasive material which will prevent chipping and/or scraping of such tubular goods.

In the preferred embodiment, the rack of the present invention is painted safety-yellow, or some other highly visible color. In the offshore oil and gas industry, tubular goods are typically unloaded from boats using cranes which can be anchored a great distance above the water line and, thus, the boats being unloaded. Because the operator of such cranes are often positioned far from said boats, it is imperative that such operators be able to see the deck of the boats and the associated equipment which they are dealing with. By making the rack of the present invention more visible, it generally allows such crane operators to see what they are doing, and to load and unload such tubular goods with greater safety.

The height of said upright support members can vary, depending upon the amount of tubular goods which are being stored and/or transported within said rack. Typically, said upright support members range between six and eight feet in length. It is generally advantageous for a worker to be able to slip one or more slings around groups of tubular goods. Thus, it is generally not recommended that such tubular goods be stacked too high, such that a deck hand or other worker could not get a sling around a bundle of pipe.

DESCRIPTION OF THE PREFERRED EMBODIMENT

Figure 1:
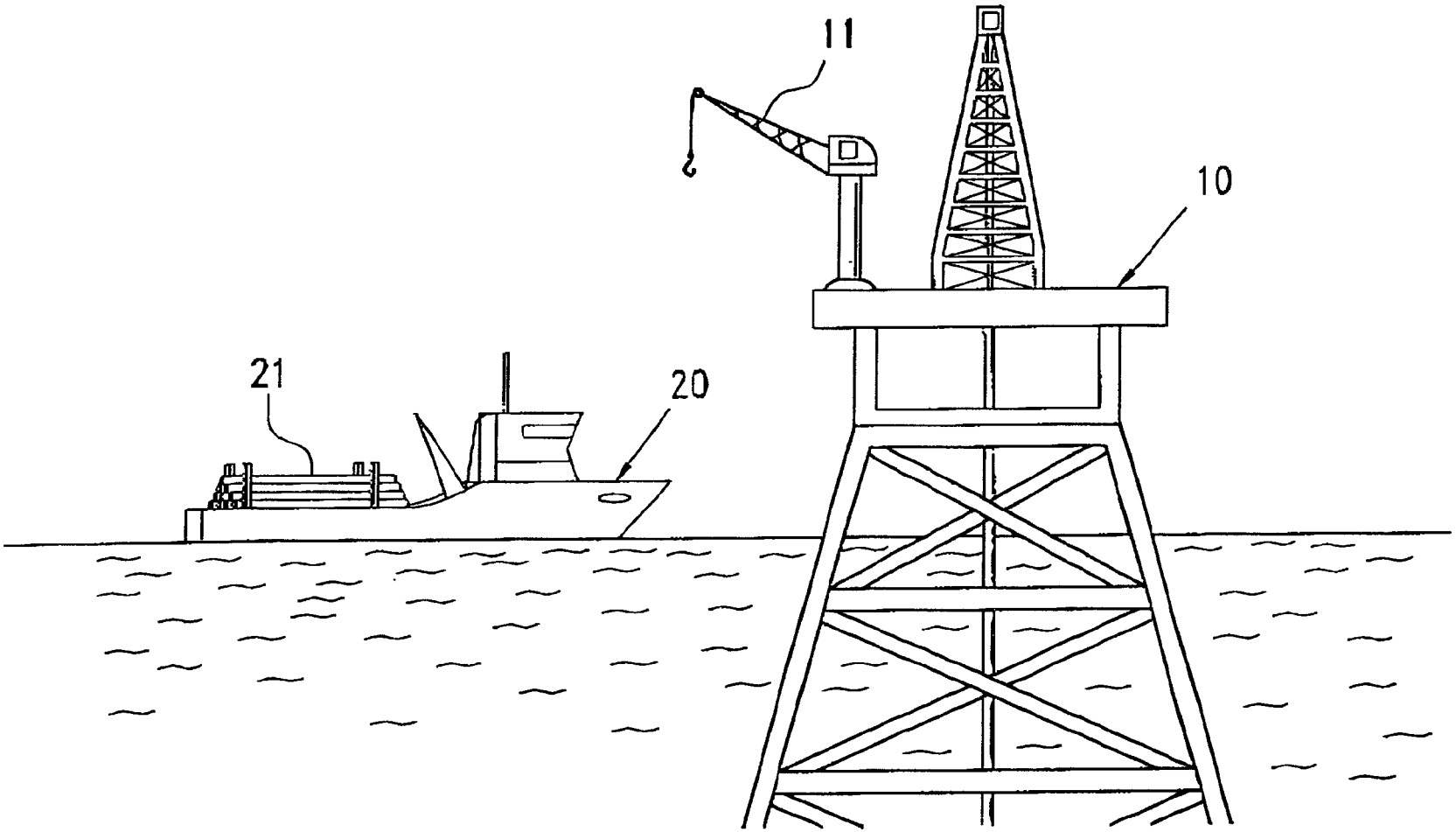
FIG. 1 depicts a side view of a marine vessel approaching an offshore oil and gas facility.

FIG. 1 depicts a view of a marine work boat 20 approaching offshore oil and gas platform 10. Crane 11 is situated on the deck of platform 10, while tubular goods 21 are loaded on the deck of work boat 20. Crane 11 can be used to transfer tubular goods from work boat 20 to offshore platform 10 for eventual use in connection with oil and gas operations.

Figure 2:
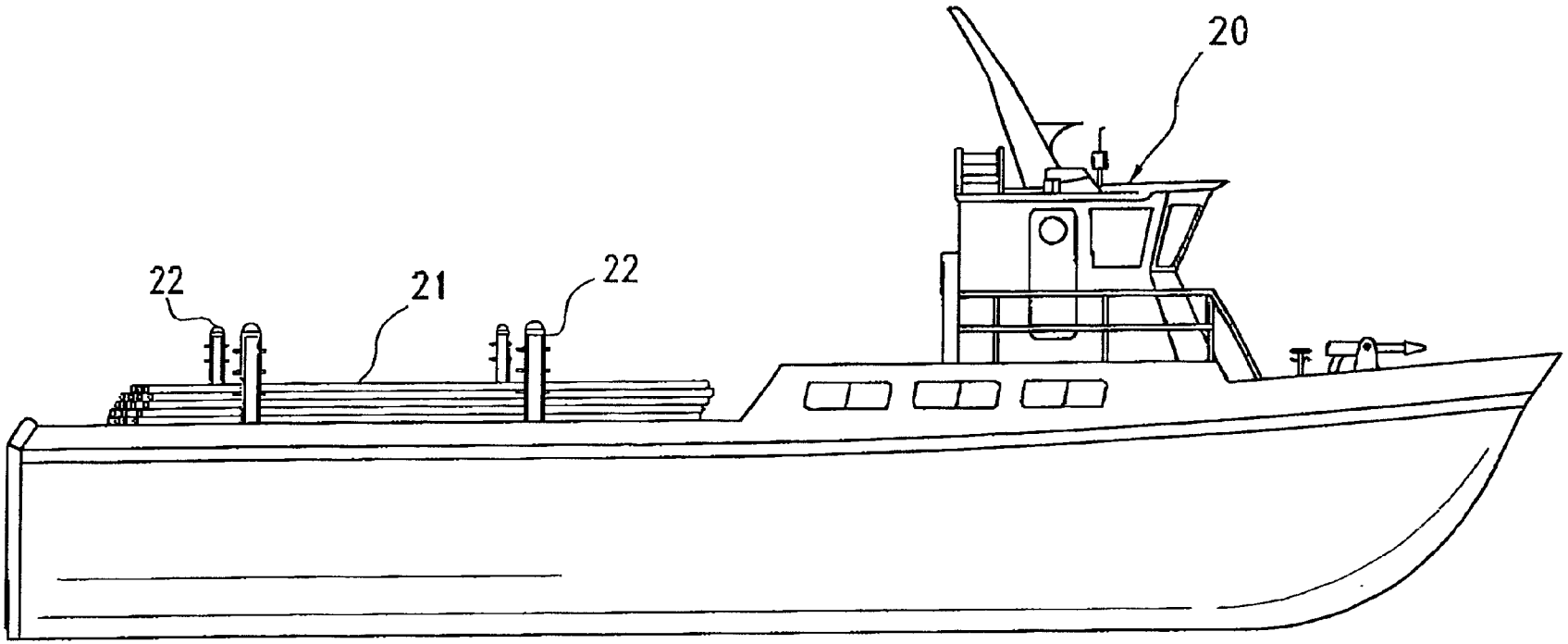
FIG. 2 depicts a side view of a work boat loaded with tubular goods.

Referring to FIG. 2, the deck of work boat 20 is loaded with tubular goods 21. Tubular goods 21 are secured in place by a pipe rack having vertical members 22. Said vertical members 22 contain tubular goods 21, and prevent said tubular goods from rolling around on the deck of work boat 20. As work boat 20 is subjected to waves and rolling seas, vertical members 22 act to hold tubular goods 21 in a stationary position.

Figure 3:
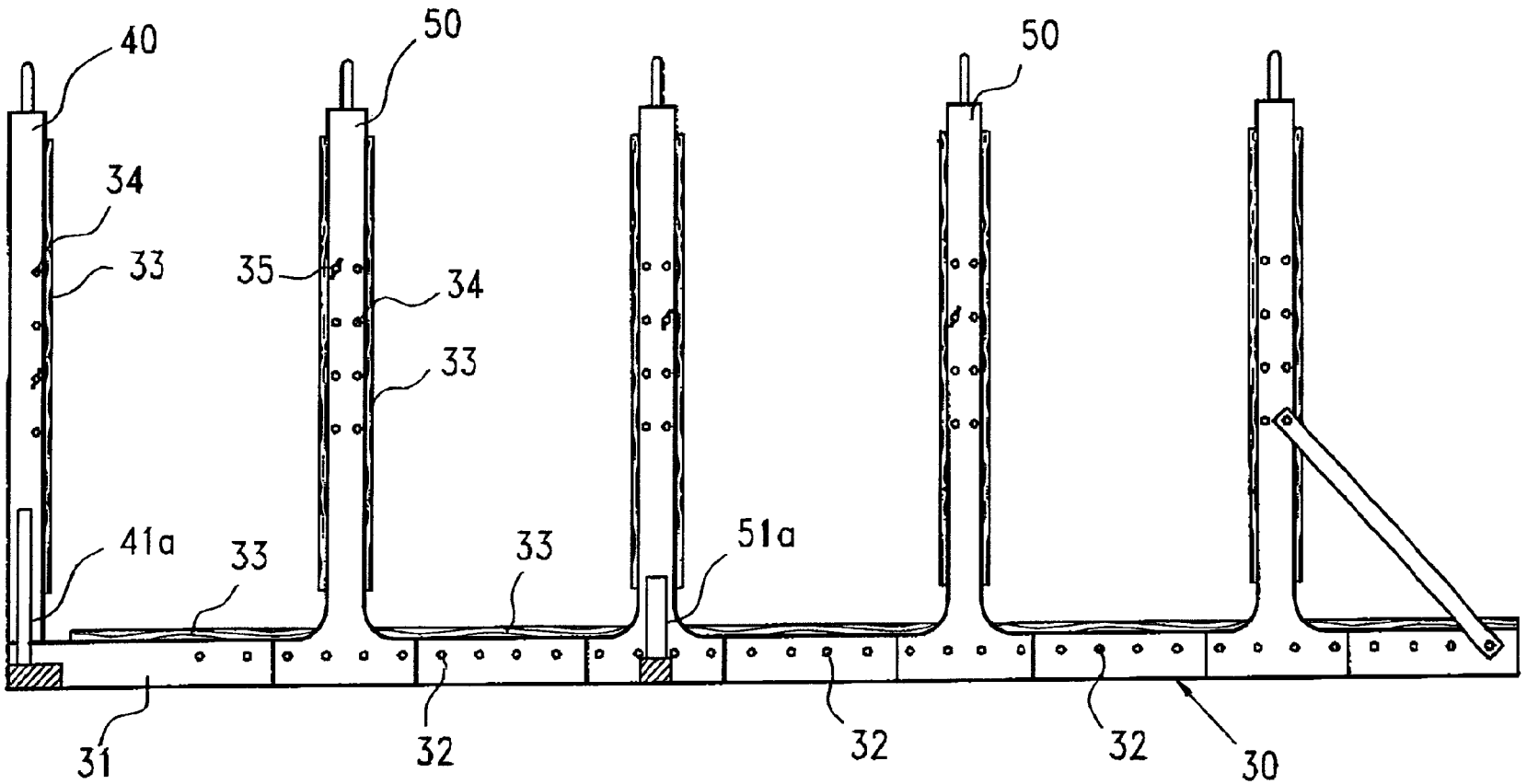
FIG. 3 depicts a side view of the adjustable pipe rack of the present invention.

FIG. 3 depicts a side view of the adjustable pipe rack 30 of the present invention. Pipe rack 30 comprises horizontal track 31, and vertical end member 40. Horizontal track 31 has a plurality of bores 32 extending through said horizontal track 30. Said bores 32 are oriented in roughly perpendicular fashion to the longitudinal axis of horizontal track 31. A plurality of vertical members 50 are slidably disposed over horizontal track 31, and can be positioned at different locations along horizontal track 31, unless otherwise secured in place. In order to ensure lateral stability, vertical end member 40 has lateral support arm 41*a*. Similarly, one or more of said slidable vertical members 50 can also be equipped with lateral support arm 51*a* to further ensure lateral stability. It should be noted that in the preferred embodiment, vertical end member 40 is integrally attached to one end of horizontal track 31. However, it is also possible that such vertical end member could also be slidably disposed on horizontal track 31, but locked in place at or near one end of said horizontal track 31.

Still referring to FIG. 3, the area defined by vertical end member 40, horizontal track 31 and slidable vertical member 50 (or, alternatively, two adjacent slidable vertical members 50, and horizontal track 31) forms a compartment or slot for containing tubular goods. In order to protect the outer surfaces of such tubular goods from becoming gouged or scarred, the surfaces of vertical end member 40 and slidable vertical members 50, as well as the upper surface of horizontal track 31, are pliant and generally non-abrasive. In the preferred embodiment, such surfaces are defined by wooden boards 33. Further, in the preferred embodiment, vertical end member 40 and slidable vertical members 50 contain a plurality of bores 34 therethrough. Wooden boards 33, which have bores therethrough aligned with the bores 34 in end member 40 and slidable vertical members 50, are held in place by pins 35. In the event that such boards become damaged, said boards can be easily and quickly replaced.

Figure 4:
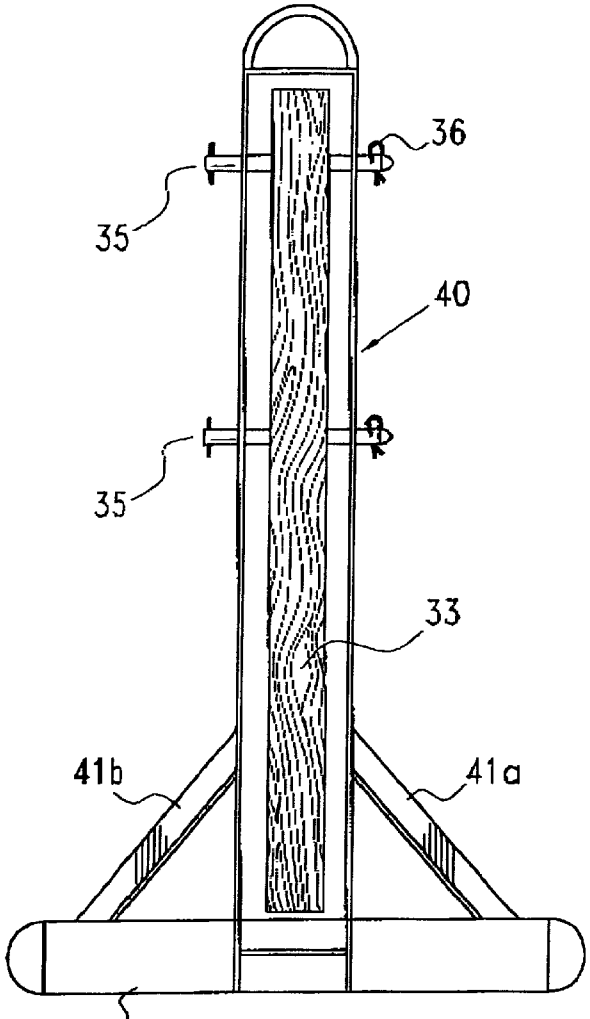
FIG. 4 depicts an end view of a vertical end member of the present invention.

FIG. 4 depicts an end view of vertical end member 40 of the present invention. The bottom of vertical end member 40 is defined by base 42, and lateral support arms 41*a* and 41*b*. Wooden board 33 is held in place using pins 35. Pins 35 can in turn be secured and prevented from slipping out of bores 34 using cotter pins 36.

Figure 6:
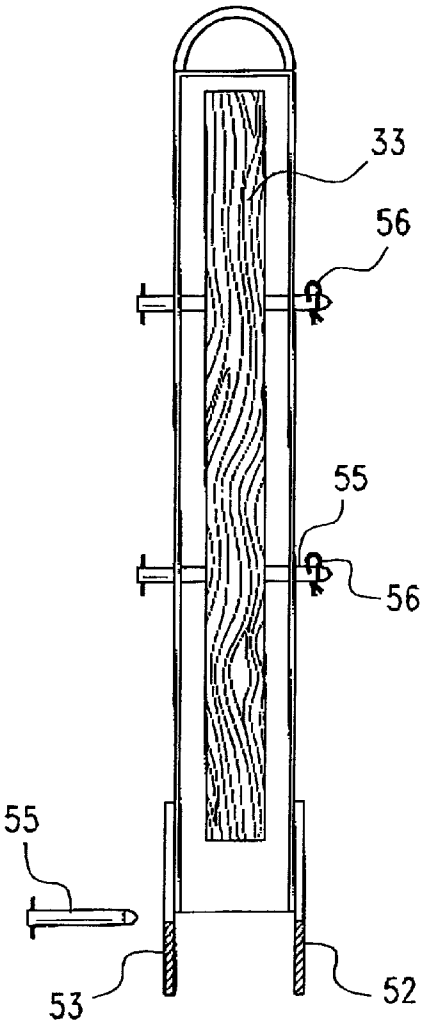
FIG. 6 depicts an end view of a slidable vertical member of the present invention.
Figure 5:
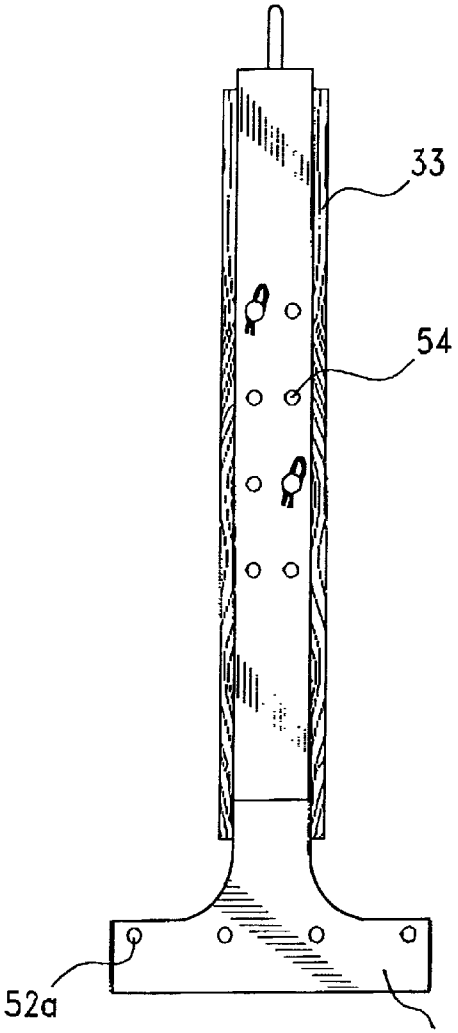
FIG. 5 depicts a side view of a slidable vertical member of the present invention.

FIGS. 5 and 6 depict side and end views, respectively, of a slidable vertical member 50 of the present invention. Referring to FIG. 6, the base of slidable vertical member 50 is formed by base plates 52 and 53. Base plate 52 has bores 52*a*, while base plate 53 also has bores 53*a* (not shown), aligned with said bores 52*a*. Parallel base plates 52 and 53 essentially form a channel, and rest along the outer sides of horizontal track 31. Bores 52*a* and 53*a* are aligned with bores 32 extending through horizontal track 31. Vertical member 50 can be pinned in place using pins 55 which extend through bores 52*a* and 53*a*, as well as bores 32 in horizontal track 31.

Slidable vertical member 50 has a plurality of bores 54 disposed therethrough. Wooden board 33 is held in place using pin 55, which can in turn be secured and prevented from slipping out of bores 54 using cotter pins 56.

Figure 8:
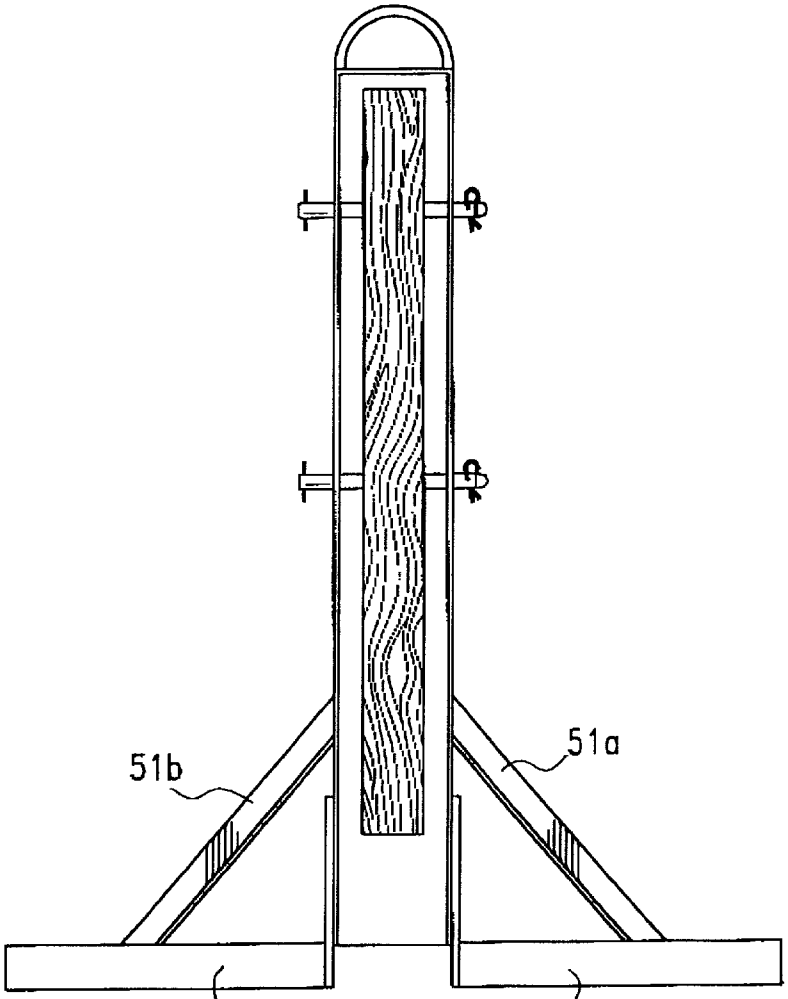
FIG. 8 depicts an end view of a slidable vertical member of the present invention having lateral base supports.
Figure 7:
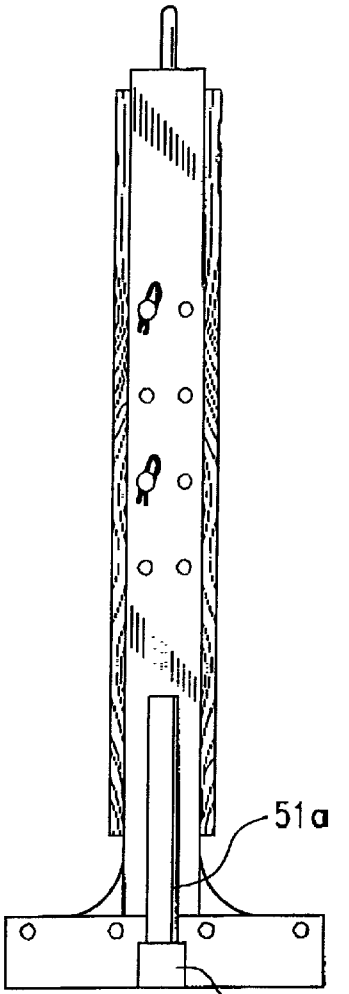
FIG. 7 depicts a side view of slidable vertical members of the present invention having lateral base supports.

FIGS. 7 and 8 depicts side and end views, respectively, of a slidable vertical member 50 of the present invention having lateral base extensions 52*b* and 53*b*. Lateral support arms 51*a* and 51*b* also provide lateral support to prevent against side-to-side tipping.

Figure 9:
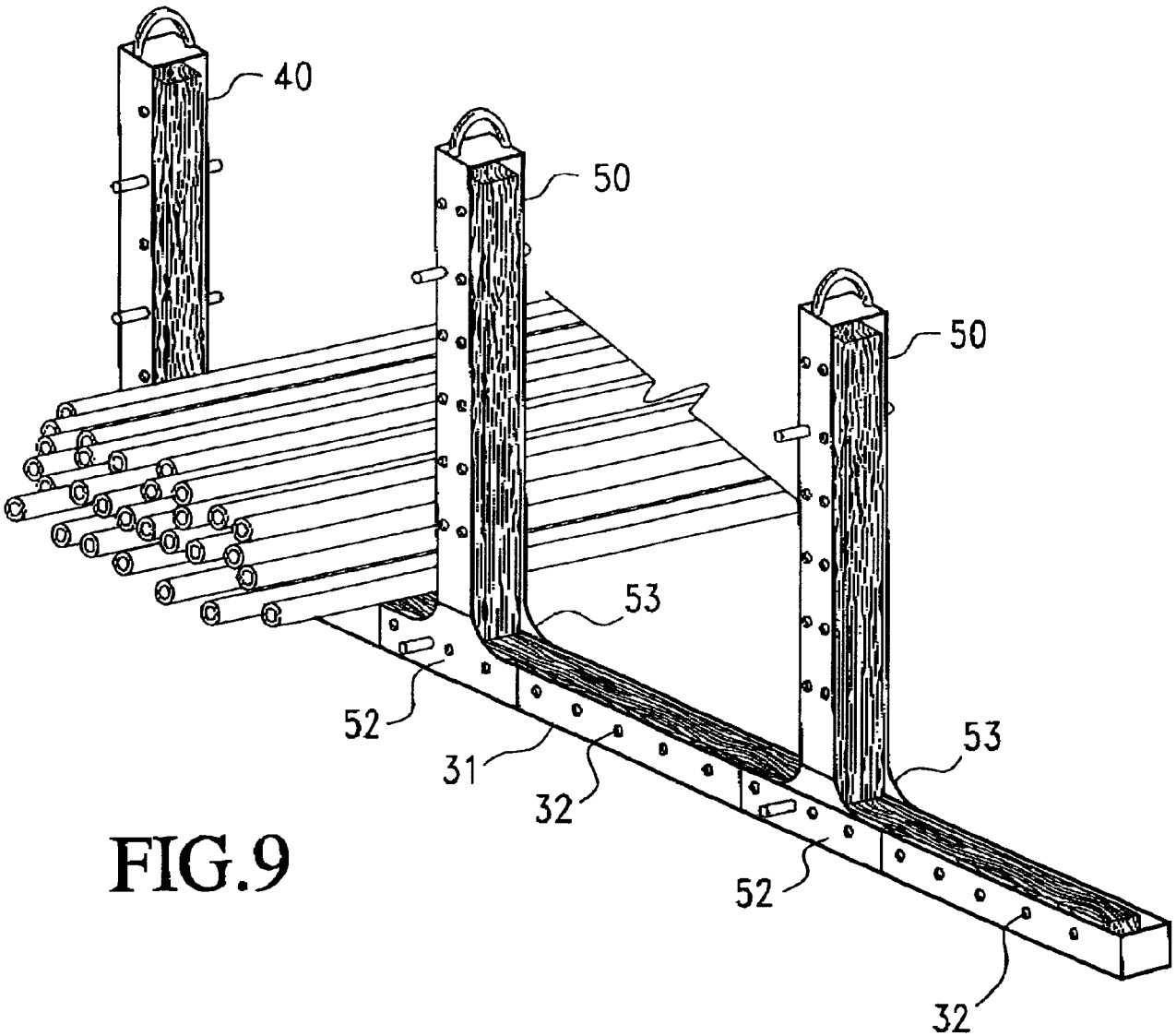
FIG. 9 depicts an overhead perspective view of the adjustable pipe rack of the present invention.

FIG. 9 depicts a perspective view of the adjustable pipe rack of the present invention. Vertical end member 40 and horizontal track 31 define a generally L-shaped structure. Bores 32 extend through horizontal track 31 and boards 33. Slidable vertical members 50 are slidably disposed over track 31; base plates 52 and 53 are positioned next to the outer surfaces of horizontal track 31. Tubular goods 91 are contained within the compartment defined by vertical end member 40, horizontal track 31, and slidable vertical member 50 which is positioned nearest to said vertical end member 40. Similarly, an additional compartment is defined between slidable vertical members 50.

Although preferred embodiments of the subject invention have been described herein, it should be understood that various changes, adaptations and modifications may be made therein without departing from the spirit of the invention and the scope of the appended claims.

What is claimed is:

1. An adjustable pipe rack comprising:

a. a horizontal track;

b. a plurality of vertical posts slidably disposed along said horizontal track, wherein at least one of said vertical posts has a first lateral support member disposed on one side of said vertical post near the base of said post, and a second lateral support member disposed on the opposite side of said vertical post near the base of said post, and wherein said first and second lateral support members are oriented substantially perpendicular to the longitudinal axis of said horizontal track; and c. means for locking said vertical posts in place at desired positions along said track.

2. The adjustable pipe rack of claim 1, wherein the surfaces of said horizontal track and vertical posts comprise non-abrasive material.

3. The adjustable pipe rack of claim 2, wherein said non-abrasive material is wood.

4. The adjustable pipe rack of claim 1, further comprising an eyelet affixed to the top of at least one vertical post.

5. An adjustable pipe rack comprising:

a. a horizontal track having a plurality of bores extending through said track, wherein the longitudinal axes of said bores are oriented parallel to one another and perpendicular to the longitudinal axis of said horizontal track;

b. a plurality of vertical posts slidably disposed along said horizontal track, wherein at least one of said vertical posts has a first lateral support member disposed on one side of said vertical post near the base of said post, and a second lateral support member disposed on the opposite side of said vertical post near the base of said post, and wherein said first and second lateral support members are oriented substantially perpendicular to the longitudinal axis of said horizontal track; and c. means for locking said vertical posts in place.

6. The adjustable pipe rack of claim 5, wherein said means for locking said vertical posts in place further comprises:

a. a first planar member, extending from the bottom of a vertical post along one side of said horizontal track, and having at least one hole extending through said first planar member;

b. a second planar member extending from the bottom of said vertical post along the opposite side of said horizontal track from said first planar member, and having at least one hole extending through said second planar member, wherein said first and second planar members are oriented parallel to one another along opposite sides of said horizontal track; and c. at least one rigid pin extending though an aligned hole in said first planar member, a bore in said horizontal track, and a hole in said second planar member.

7. The adjustable pipe rack of claim 5, wherein the surfaces of said horizontal track and vertical posts comprise non-abrasive material.

8. The adjustable pipe rack of claim 7, wherein said non-abrasive material is wood.

9. The adjustable pipe rack of claim 5, further comprising an eyelet affixed to the top of at least one vertical post.

10. An adjustable pipe rack comprising:

a. a horizontal track;

b. a stationary upright attached to one end of said horizontal track, having a first lateral extension disposed near the base of said upright on one side of said horizontal track, and a second lateral extension disposed near the base of said upright on the opposite side of said horizontal track from said first lateral extension;

c. one or more vertical posts slidably disposed along said vertical track; and d. means for securing said one or more vertical posts at desired positions along said track.

11. The adjustable pipe rack of claim 10, wherein at least one of said vertical posts has a first lateral extension disposed near the base of said post on one side of said horizontal track, and a second lateral extension disposed near the base of said post on the opposite side of said horizontal track from said first lateral extension.

12. The adjustable pipe rack of claim 10, wherein said means for securing said one or more vertical posts at desired positions along said horizontal track further comprises:

a. a plurality of bores extending through said horizontal track, wherein the longitudinal axes of said bores are oriented parallel to one another and perpendicular to the longitudinal axis of said horizontal track;

b. a bracket at the base of each vertical post, wherein each bracket has a recess for slidably receiving said horizontal track, and aligned holes oriented perpendicular to the longitudinal axis of said horizontal track; and c. at least one rigid pin extending though the aligned holes in a bracket and a bore in said horizontal track.

13. The adjustable pipe rack of claim 10, wherein the surfaces of said horizontal track and vertical posts comprise non-abrasive material.

14. The adjustable pipe rack of claim 13, further comprising:

a. a recessed area along the upper surface of said horizontal track;

b. recessed areas along the sides of said vertical posts; and c. wooden members received within the recessed areas of said horizontal track and said vertical posts.

15. The adjustable pipe rack of claim 10, further comprising an eyelet affixed to the top of one or more vertical posts.

* * * * *